United States Patent [19]

Honey et al.

[11] Patent Number: 4,479,863

[45] Date of Patent: Oct. 30, 1984

[54] CELL TOP INSULATOR

[75] Inventors: Ronald N. Honey, Rossland; Robert E. Manwell, Trail; Clifford J. Krauss, Trail; Douwe Ybema, Trail, all of Canada

[73] Assignee: Cominco Ltd., Vancouver, Canada

[21] Appl. No.: 595,897

[22] Filed: Apr. 2, 1984

[30] Foreign Application Priority Data

Apr. 5, 1983 [CA] Canada ..... 425172

[51] Int. Cl.[3] ..... C25B 9/00; C25C 7/00; C25D 17/00

[52] U.S. Cl. ..... 204/279; 204/267; 204/286; 204/297 R

[58] Field of Search ..... 204/279, 267–270, 204/286, 297 R

[56] References Cited

U.S. PATENT DOCUMENTS 3,697,404 10/1972 Paige ..... 204/267
3,763,029 10/1973 Karn ..... 204/279
3,929,614 12/1975 Hirohira ..... 204/267 X

FOREIGN PATENT DOCUMENTS 2524941 12/1976 Fed. Rep. of Germany ... 204/297 R

*Primary Examiner*—Donald R. Valentine
*Attorney, Agent, or Firm*—Arne I. Fors; Robert F. Delbridge

[57] ABSTRACT

An insulator for supporting a spooled electrode contact bar and head bars of removable, alternating cathodes and anodes in an electrolytic cell. The insulator comprises an elongated body formed of a synthetic material having a longitudinal outwardly and downwardly sloping upper surface extending from a center line to the side edges of the body, a row of equi-spaced shoulders formed longitudinally on each upper surface adjacent to the said center line offset relative to each other, each row of shoulders having a transverse channel formed between each pair of adjacent shoulders for draining liquid towards a side edge of the body, a longitudinal V-shaped groove formed between the two rows of shoulders for supporting the spooled electrode contact bar between the rows of shoulders and a cavity formed in each upper surface opposite each shoulder between the shoulder and the respective edge of the body for receiving an insulating block therein for supporting one end of the electrode head bars.

8 Claims, 5 Drawing Figures

CELL TOP INSULATOR

This invention relates to the electrolytic recovery of metals and, more specifically, relates to a self-draining insulator for supporting electrodes in electrolytic cells.

In the electrolytic recovery of metals by electrowinning or electrorefining, a number of cathodes and anodes are suspended in electrolytic cells and the electrodes are usually supported on the sides of the cells. The anodes and cathodes are alternately arranged and are supported from head bars such that one end of the head bar makes electrical contact with an electrical conductor, such as a bus bar, while the other end of the head bar is supported on an electrically non-conductive device or insulator.

Many configurations for bus bars and insulators as well as electrode head bars are disclosed in the prior art. The bus bars or contact bars are usually of a rectangular, semi-circular, triangular or circular cross-section. One such contact bar having circular cross-sections in a spooled configuration is disclosed in U.S. Pat. No. 4,035,280, which issued on July 12, 1977 to the assignee of the present invention. The spooled electrode contact bar according to this patent is particularly useful in combination with the insulator of the present invention and the disclosure of the patent is hereby incorporated by reference.

The spooled electrode contact bar of the aforementioned patent consists of cylindrical end sections and a spooled central section which is formed from a plurality of identical grooves, the grooves each comprising a cylindrical middle portion which is of substantially smaller diameter than the cylindrical end sections and two oppositely disposed right frusto-conical portions facing one another on the opposite sides of the cylindrical middle portion of each groove. This contact bar provides low resistance tangential metal-to-metal contacts between V-shaped notches in the ends of the electrode head bars and the surfaces of the frusto-conical portions of the contact bars.

Insulators used in electro-deposition processes may have a variety of configurations. U.S. Pat. No. 315,265 shows the use of insulating rods for one end of electrode head bars and U.S. Pat. Nos. 789,353, 1,095,748, 1,501,692 and 3,579,431 show the use of non-conducting rectangularly-shaped insulators which carry either one end of the electrode head bar or the current distributing conductor or contact bar. According to Trans. AIMME 159 206 (1944), electrode head bars are disclosed which fit in grooves in insulators positioned on the top of the cell edges to define electrode spacing. U.S. Pat. No. 2,443,112 discloses notched spacer insulators which are preferably made up in sections to be fitted together and mounted on the cell walls. According to Australian Mining of Mar. 15, 1969, pages 49–50, anodes and cathodes rest on molded polypropylene insulators laid on top of the cell walls and the insulators are shaped to receive the electrode head bars and to maintain top spacing between the electrodes. According to U.S. Pat. No. 3,697,404, there is provided a capping board for electrolytic cells comprising a plurality of the dove-tailed, interlocking, molded plastic sections supported on the cell walls to support electrode head bars in a fixed spaced relation. The board provides longitudinal and transverse alignment and spacing of the electrodes.

A major disadvantage of the insulators of the prior art is the lack of means for draining electrolyte from the insulators. Inherent in most, if not all, electrolytic processes, is the occurrence of spraying or splashing of electrolyte onto the head bars, contact bars and insulators which results in corrosion. Those parts which are exposed to this spraying or splashing and which are made of a conductive metal such as copper to provide good electrical contacts, are especially subject to corrosion by electrolyte. As can be seen, for example, in the above-mentioned U.S. Pat. No. 3,697,404, no means for drainage of electrolyte from the capping board and from the channel containing the contact bar are provided.

It would, therefore, be advantageous to have a self-draining insulator for supporting the electrode contact bar and the ends of electrode head bars to alleviate corrosion problems.

We have now provided a one-piece insulator for the support of electrode contact bars as well as the ends of electrode head bars, which insulator is self-draining of any liquid whereby corrosion is reduced. More specifically, a self-draining insulator is provided wherein the surfaces of the insulator, on which the contact bar and the ends of head bars are supported, slope such that liquid can easily drain off the insulator and flow back into the electrolytic cell.

Accordingly, there is provided an insulator for electrolytic cells for the recovery of metals, said insulator supporting a spooled electrode contact bar and head bars of removable, alternating cathodes and anodes which are alternately supported at one side of the cell on said contact bar and on the other side of the cell on said insulator, said insulator comprising an elongated body having a longitudinal centre line, said body having a substantially flat bottom surface for mounting the insulator on the top of cell walls and said body having outwardly and downwardly sloping upper surfaces extending from said centre line to the side edges of the body, a row of equi-spaced shoulders formed longitudinally on each upper surface adjacent to the said centre line, each said row of shoulders having a transverse channel formed between each pair of adjacent shoulders for draining liquid towards a side edge of the body, a longitudinal V-shaped groove formed between the two rows of shoulders for supporting said spooled electrode contact bar between said rows of shoulders, the shoulders of each row being longitudinally offset relative to the shoulders of the opposite row whereby the channels formed between the adjacent shoulders of one row are in alignment with and abut shoulders of the opposite row, a cavity formed in each upper surface opposite each shoulder between the shoulder and the respective edge of the body for receiving an insulating block therein, whereby the electrode contact bar can support an end of the head bar of a cathode or anode at one side of a cell and said blocks inserted in the cavities can support the opposite end of said head bar on the opposite side of the cell.

In a preferred embodiment, each of the sloping upper surfaces is coplanar from the centre line to the outer edge of the body between the shoulders and between the corresponding cavities. Each of the cavities may be rectangular, triangular, circular, or semi-circular in cross-section and each of the cavities has a drainage slot for draining liquid to the corresponding outside edge of the insulator body.

Opposite ends of the insulating body may each have a longitudinal extension supporting a locating-probe bracket comprising a plate having a circular aperture formed centrally thereof.

The insulator of the present invention will now be described with reference of the accompanying drawings, in which.

Like reference characters refer to like parts throughout the description of the drawing.

Figure 1:
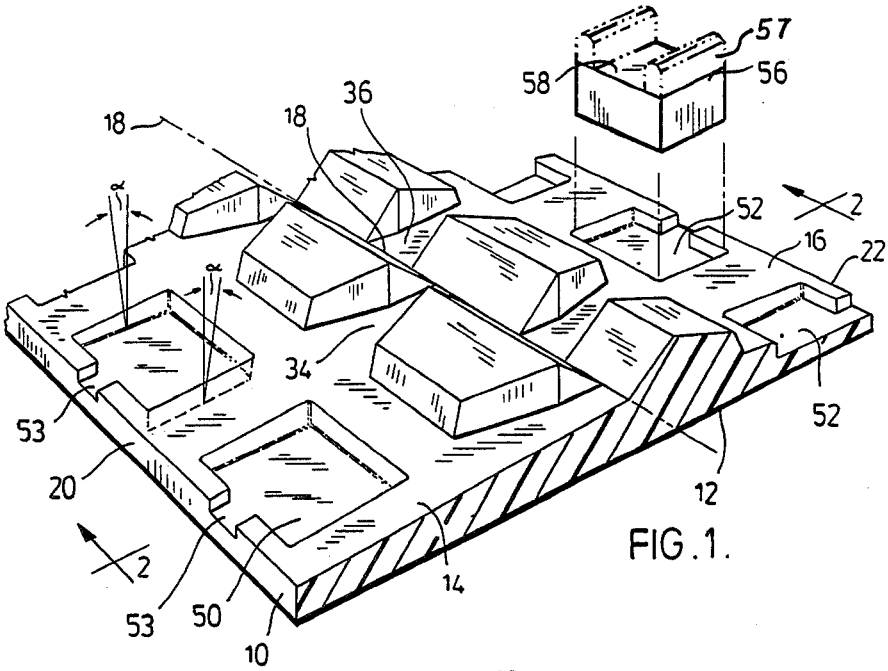
FIG. 1 is a perspective view, partly cut away, of the insulator of the invention.

With reference now to the drawing, the insulator of the present invention comprises an elongated body 10 having a substantially flat undersurface 12 and a pair of outwardly and downwardly sloping upper surfaces 14, 16 extending from longitudinal centre line depicted by numeral 18 to the respective outer edges 20, 22.

Figure 5:
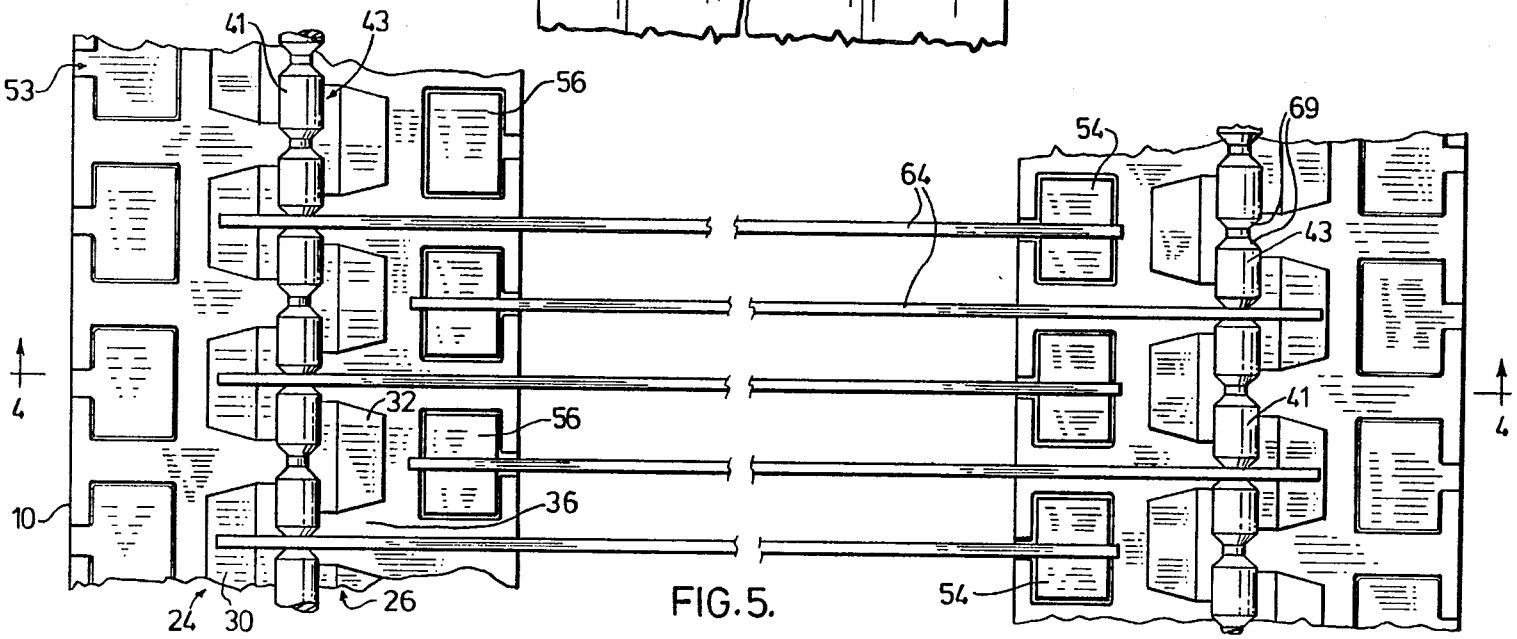
FIG. 5 is a plan view of the assembly shown in FIG. 4.

Rows 24, 26 of equi-spaced shoulders 30, 32 are formed longitudinally on upper surfaces 14, 16 respectively adjacent centre line 18 and extend substantially one-half the width of upper surfaces 14, 16. Each pair of adjacent shoulders 30 have channel 34 formed therebetween and each pair of adjacent shoulders 32 have channels 36 formed therebetween, each of channels 34, 36 preferably having a surface coplanar with respective upper surfaces 14, 16 whereby liquid collecting between shoulders 30 and between shoulders 32 will flow by gravity to the outer edges of the insulator body. The shoulders 30 of row 24 are longitudinally offset or staggered relative to the shoulders 32 of row 26 such that passages between the shoulders of one row will be in alignment with and abut the shoulders of the opposite row, as shown most clearly in FIG. 1. As shown in FIGS. 1 and 5, each of the shoulders 30, 32 has sides which are converging in part, forming channels 34 between adjacent shoulders 30 and adjacent shoulders 32 which are partly diverging towards the outer edges 20, 22 of the insulator body. Alternatively, the shoulders 30, 32 may have other suitable shapes, such as a generally rectangular shape, channels 34 then having generally parallel sides.

Figure 4:
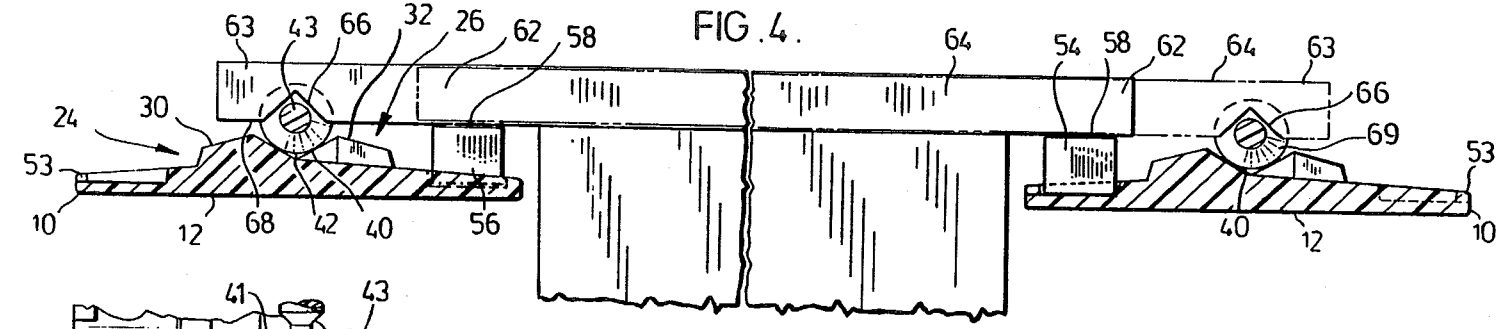
FIG. 4 is a side elevation, partly in section and partly cut away, through line 4—4 of FIG. 5, showing head bars of a cathode and an anode supported on a pair of spaced apart insulators mounted on opposite side walls of an electrolytic cell, not shown.

Longitudinal V-shaped notch 40 is formed between opposite rows 24, 26 of the shoulders to accomodate and support spools 41 of electrode contact bar 43, as shown most clearly in FIGS. 4 and 5. The apex 42 of the V-shaped notch 40 preferably is collinear with the juncture of upper surfaces 14, 16 where they meet at centre line 18 to enable liquid accummulating in notch 40 to drain into passages 34, 36. The upper surfaces 44, 45 and 46, 47 of shoulders 30, 32 respectively preferably are sloped downwardly towards the outer edges of the body to facilitate drainage of liquid therefrom.

Figure 2:
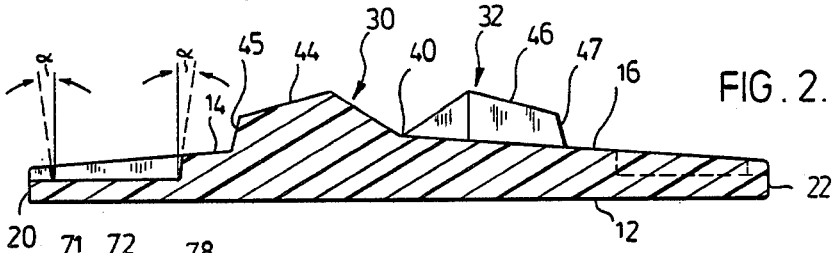
FIG. 2 is a transverse section taken along the line 2—2 of FIG. 1.

Cavities 50, 52 are formed in upper surfaces 14, 16 respectively such that a cavity is positioned opposite each shoulder for receiving insulating blocks 54, 56 therein, as shown most clearly in FIGS. 1, 4 and 5. Cavities 50, 52 preferably are rectangular in cross-section with walls having a draft or taper angle $\alpha$ of about 3° to the vertical as viewed in FIG. 2 to facilitate molding of the insulator body. Preferably, each cavity 50, 52 is provided with a drainage slot 53, as shown. Cavities 50, 52 may be rectangular, triangular, circular, or semicircular in cross-section to receive insulating blocks of corresponding shape. Each insulating block 54, 56 has a planar, horizontal upper surface 58 for supporting the ends 62 of head bars 64 and, if desired, the insulating blocks may be provided with one or two ridges 57, as shown in ghost lines in FIG. 1, positioned on horizontal upper surface 58 at one or both sides thereof parallel to the long axis of said ends 62. Such ridges 57, which preferably have rounded top surfaces, assist in aligning the electrodes and in maintaining the desired electrode spacing. The opposite ends 63 of each head bar 64 have an inverted V-shaped notch 66 formed in its underside 68 for optimum metal-to-metal contact between the head bar 64 and side surfaces of the opposed, frustoconical portions 69 of the contact bar 43. When positioned in the cavities, the openings between the insulating blocks and the walls of the cavities are filled with a sealing and bonding compound. The blocks are preferably made of polypropylene.

Insulator body 10 preferably is molded from a rigid synthetic material such as fibre-reinforced polyester (FRP), or the like which has good resistance to heat, impact and corrosion, has good insulating properties and has the appropriate coefficient of thermal expansion.

Figure 3:
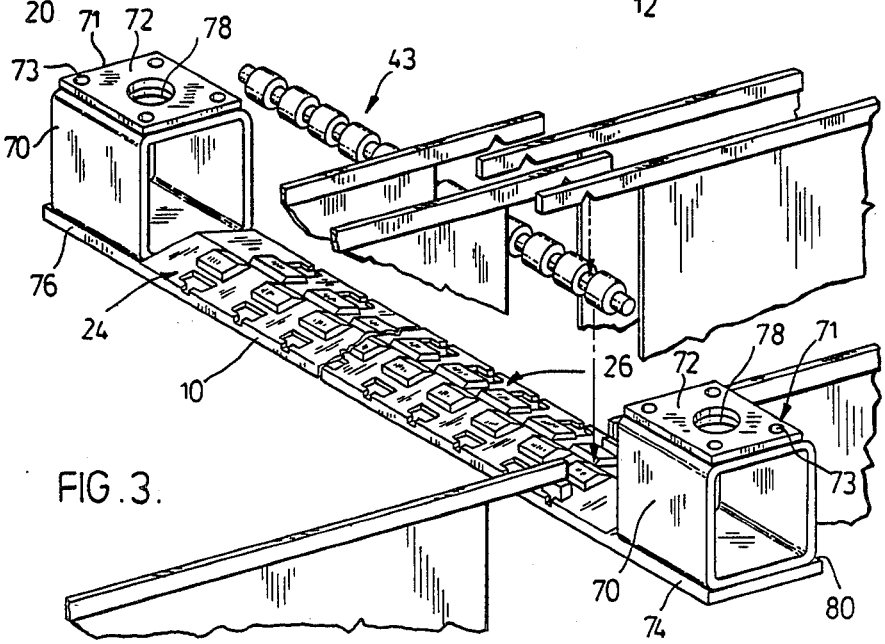
FIG. 3 is a perspective view, partly exploded, of an insulator of the present invention showing longitudinal extensions formed at each end thereof adapted to support locating-probe brackets, a contact bar vertically spaced from the insulator and portions of cathode and anode head bars.

With reference now to FIG. 3, a bracket 70 made of a synthetic material such as FRP or metal is secured by means of glass fibre, bolts, or the like securing means, not shown, onto longitudinal extensions 74, 76 formed at the ends of insulator body 10. Bracket 70 has a stainless steel cover plate 71 attached to its top, as shown. Cover plate 71 is vertically adjustable in a horizontal plane by adjustably bolting the plate through holes 73 to bracket 70. Both bracket 70 and cover plate 71 have a corresponding central aperture 78. Brackets 70 may be rectangular in plan with upper surface 72 raised above the upper surface 80 of extensions 74, 76 to permit the insertion of an indexing or locating probe, not shown, into central apertures 78. Such probes can be part of apparatus that allow the manipulation of electrodes.

The present invention provides a number of important advantages. The insulators can be readily installed to permit accurate locating of contact bars and cathode and anode head bars for longitudinal and lateral alignment of cathodes and anodes within an electrolytic cell. Drainage of electrolyte from the insulators is complete, minimizing corrosion of metal components.

It will be understood that modifications can be made in the embodiments of the invention described and illustrated herein without departing from the scope and purview of the invention as defined in the appended claims.

What we claim as new and desire to protect by Letters Patent of the United States is:

1. An insulator for use in electrolytic cells for the support of a spooled electrode contact bar and head bars of removable, alternating cathodes and anodes which are alternately supported at one side of the cell on said contact bar and on the other side of the cell on said insulator, said insulator comprising an elongated body having a longitudinal centre line, said body having a substantially flat bottom surface for mounting the insulator on the top of cell walls and said body having outwardly and downwardly sloping upper surfaces extending from said centre line to the side edges of the body, a row of equi-spaced shoulders formed longitudinally on each upper surface adjacent to the said centre line, each said row of shoulders having a transverse channel formed between each pair of adjacent shoulders for draining liquid towards a side edge of the body, a longitudinal V-shaped groove formed between the two rows of shoulders for supporting said spooled electrode contact bar between said rows of shoulders, the shoulders of each row being longitudinally offset relative to the shoulders of the opposite row whereby the channels formed between the adjacent shoulders of one row are in alignment with and abut shoulders of the opposite row, a cavity formed in each upper surface opposite each shoulder between the shoulder and the respective edge of the body for receiving an insulating block therein, whereby the electrode contact bar can support an end of the head bar of a cathode or anode at one side of a cell and said blocks inserted in the cavities can support the opposite end of said head bar on the opposite side of the cell.

2. An insulator as claimed in claim 1 in which each outwardly and downwardly sloping upper surface extending from the centre line to a side edge of the body between the shoulders and the cavities is substantially coplanar.

3. An insulator as claimed in claim 1 in which each of the cavities may be rectangular, triangular, circular, or semi-circular in cross-section and each of the cavities has a drainage slot for draining liquid to an outside edge of the insulator body.

4. An insulator as claimed in claim 1, in which said insulator has an elongated body with a longitudinal extension formed at each end and a bracket secured to each of said longitudinal extensions, said bracket including a cover plate with an aperture formed therein for receiving an indexing or locating probe.

5. An insulator as claimed in claim 1, which additionally comprises an insulating block for insertion into each of the cavities opposite one row of shoulders, said block having a planar, horizontal upper surface and having a rectangular, triangular, circular, or semi-circular cross-section corresponding to the shape of the cavities.

6. An insulator as claimed in claim 1, wherein said insulator is formed of a rigid synthetic material.

7. An insulator as claimed in claim 1, wherein said insulator is formed of a fibre-reinforced polyester.

8. An insulator as claimed in claim 6 which additionally comprises an insulating block for insertion into each of the cavities opposite one row of shoulders, said block having a planar, horizontal upper surface and having a rectangular, triangular, circular, or semi-circular cross-section corresponding to the shape of the cavities, said block being formed of a rigid polypropylene.

* * * * *